US011746764B2

(12) United States Patent
Nema

(10) Patent No.: US 11,746,764 B2
(45) Date of Patent: Sep. 5, 2023

(54) DUAL PNEUMO-HYDRAULIC PUMP UNIT

(71) Applicant: DRAUSUISSE BRASIL COMERCIO E LOCACAO DE UNIDADES HIDRAULICAS INTELIGENTES S.A., Sao Paulo (BR)

(72) Inventor: Ercio Miguel Nema, Sao Paulo (BR)

(73) Assignee: DRAUSUISSE BRASIL COMERCIO E LOCACAO DE UNIDADES HIDRAULICAS INTELIGENTES S.A., Sao Paulo (BR)

( * ) Notice: Subject to any disclaimer, the term of this patent is extended or adjusted under 35 U.S.C. 154(b) by 204 days.

(21) Appl. No.: 17/289,395

(22) PCT Filed: Oct. 23, 2019

(86) PCT No.: PCT/BR2019/000033
§ 371 (c)(1),
(2) Date: Apr. 28, 2021

(87) PCT Pub. No.: WO2020/087139
PCT Pub. Date: May 7, 2020

(65) Prior Publication Data

US 2021/0396218 A1 Dec. 23, 2021

(30) Foreign Application Priority Data

Oct. 31, 2018 (BR) ..... 1020180724800

(51) Int. Cl.
*F04B 9/133* (2006.01)
*F04B 23/02* (2006.01)
*F04B 23/06* (2006.01)

(52) U.S. Cl.
CPC ..... *F04B 9/133* (2013.01); *F04B 23/02* (2013.01); *F04B 23/06* (2013.01)

(58) Field of Classification Search
CPC ..... F04B 9/133; F04B 9/1253; F04B 9/111; F04B 9/113; F04B 9/115; F04B 9/131;
(Continued)

(56) References Cited

U.S. PATENT DOCUMENTS 1,042,420 A * 10/1912 Fee ..... F04B 9/10 91/304
2,381,298 A * 8/1945 McCormick ..... F01B 23/08 417/280

(Continued)

FOREIGN PATENT DOCUMENTS

DE 1030686 B 5/1958
DE 2743452 A * 3/1978 ..... F04B 13/02

(Continued)

OTHER PUBLICATIONS

European Search Report dated Jun. 20, 2022 in connection with International Application No. PCT/BR2019/000033, 8 pages.

(Continued)

*Primary Examiner* — Thomas Fink
(74) *Attorney, Agent, or Firm* — BAKER & MCKENZIE LLP

(57) ABSTRACT

A dual pneumo-hydraulic pump unit is provided. The dual pneumo-hydraulic pump unit includes a central pneumatic cylinder that works in the center of two hydraulic piston pumps. The two hydraulic piston pumps are mounted parallel to the plunger of the central pneumatic cylinder, positioned one on each side. Compressed air or other pressurized gases are used to move the central pneumatic cylinder, as a source of motor energy to pump oil under pressure to a hydraulic pressure accumulator for later activation of hydraulic actuators.

9 Claims, 2 Drawing Sheets

(58) Field of Classification Search
CPC ..... F04B 9/135; F04B 23/16; F04B 19/022; F04B 13/02; F01B 23/08; F01B 11/00; F01B 15/02
See application file for complete search history.

(56) References Cited

U.S. PATENT DOCUMENTS 2,891,514 A * 6/1959 Moeller ..... F15B 11/076 92/9
3,132,376 A * 5/1964 Ackerman ..... B29C 48/48 425/149
4,528,894 A * 7/1985 Crosby ..... F15B 11/076 91/35
4,765,225 A 8/1988 Birchard
5,388,725 A * 2/1995 Lichfield ..... F04B 13/02 417/397
5,564,913 A 10/1996 Lee
8,186,972 B1 5/2012 Glauber
9,926,947 B2 3/2018 Villar et al.
11,131,192 B2 * 9/2021 Goldfarb ..... F16H 25/20
2003/0121411 A1 * 7/2003 Hoshi ..... F01B 11/009 92/66
2009/0047144 A1 * 2/2009 Leece ..... F04B 25/005 417/415
2016/0230786 A1 8/2016 Nema
2018/0370075 A1 * 12/2018 Schwabl ..... B29B 7/603
2022/0247052 A1 * 8/2022 Hirai ..... F04B 13/00

FOREIGN PATENT DOCUMENTS

EP 3315772 A1 5/2018
FR 1362958 A * 6/1964
WO 2008012704 B1 1/2008

OTHER PUBLICATIONS

International Search Report dated Jan. 7, 2020 in International Application No. PCT/BR2019/000033.

* cited by examiner

DUAL PNEUMO-HYDRAULIC PUMP UNIT

CROSS-REFERENCE TO RELATED APPLICATIONS

This U.S. patent application is a 35 U.S.C. 371 national stage application of international patent application number PCT/BR2019/000033 filed on Oct. 23, 2019 which claims priority to Brazilian patent application number 1020180724800 filed on Oct. 31, 2018 which are hereby incorporated by reference in their entireties herein for all purposes.

FIELD OF THE INVENTION

The present patent of invention refers to a dual hydraulic pump driven by compressed air, for application in machines and equipment that use hydraulic force to perform work, especially in environments with flammable gases, or subject to fires caused by spark generated by electrical engines.

SUMMARY OF THE INVENTION

The invention has a central pneumatic cylinder that moves the hydraulic liners of two different pumps, which are mounted in parallel and symmetrically positioned, one on the left side and the other on the right side of the pneumatic cylinder, said pumps fixed on two bearings through the ends of the hydraulic rods which are actually the pistons of the pumps, which have holes through which the hydraulic oil from the reservoir passes and then exits pressurized to fill a pressure accumulator, what has the function of storing a certain volume of pressurized oil, to allow greater speed in the actuators the moment they are used.

BACKGROUND OF THE INVENTION

The so-called hydropneumatic pumps have the function of pumping hydraulic oil using compressed air as an energy source and are capable of generating high hydraulic pressures, however with a low flow volume.

Normally, these pumps are each composed of a pneumatic through-rod cylinder and, at the ends, has a hydraulic chamber separated by a hydraulic plunger and two one-way check valves, whose function is to draw the hydraulic oil from a reservoir when the pneumatic cylinder moves back and pushes out the pressurized oil when the pneumatic cylinder advances, making this pumping movement steadily.

The hydropneumatic pumps have some limiting characteristics, listed below:

- The interruption of the oil flow during the reversal of the forward or backward movement of the hydropneumatic pump, meaning the movement of a hydraulic actuator is not constant;
- Displaced oil volume: hydropneumatic pumps displace low oil volume with each advance and, when larger volumes are required, the physical dimensions of the pump significantly increase in the axial direction;
- It does not provide high speed in the movement of the actuators: by displacing low volume of oil in each advance and not maintaining a constant flow in the pumping, the oil flow provided by the pump does not allow great speeds in its displacement.

STATE OF THE ART

The state of the art, referring to this technological segment, presents some documents already published. This is the case of U.S. Pat. No. 3,249,053A dated May 3, 1996, which describes a CONTROL SYSTEM FOR HYDRAULIC AND INTENSIFYING PUMPS, which reports a system that works with hydraulic pumps in line, mounted on the same axial axis, producing pulsating and low flow movements of oil.

Document CN2777258 dated May 3, 2006, describes a pressure booster, particularly a two-stage air-liquid transmission pressure booster, adopting the fluid pressure increase technology. For the structure, a first stage hydraulic cylinder, a second stage pneumatic cylinder and a piston are respectively distributed symmetrically on both sides of an air cylinder, and an air source is connected to the air cylinder by means of a tubing and a pneumatic reversible valve. An oil tank is connected, respectively, to a first-stage hydraulic cylinder cavity and to a second-stage hydraulic cylinder by means of ducts and one-way valves. The model adopts a two-way two-stage air-liquid transmission pressure reinforcement structure, and the conversion of a high pressure oil supply state and a low-pressure oil supply state can be automatically completed, according to the requirement of a working condition, the movement being performed at high speed at the time of the light load and low speed at the time of heavy load.

Technically, this Chinese document works with hydraulic pumps at the ends of the pneumatic cylinder, which produces irregular flow due to the pulsation generated by the reversal in the direction of the advance or return of the pneumatic cylinder, and occupies a lot of physical space in the axial direction of the axis.

The document US20160230786A1, published on Aug. 11, 2016, describes a HYDRAULIC PRESSURE GENERATION UNIT WITH PNEUMATIC PERFORMANCE, particularly a multifunction unit driven by low pressure air, comprising at least a pump, preferably two pumps, pneumatically automated, comprising a pneumatic cylinder with a medial plunger, besides two symmetrical hydraulic plungers and opposite, limiting an upper hydraulic chamber and another lower hydraulic chamber with different volumes, wherein since they work in parallel and out of phase, a reduced volume of oil is required and their pulsatile movement is removed.

Explaining further, the document in the previous paragraph uses a pair of pumps that work out of phase in order to eliminate the pulsation effect, which is the interruption of the oil flow during the reversal of the forward and return movement of the pneumatic cylinder, which remains limited in volume of oil displaced per minute. This volume is limited to the travel time of the pneumatic cylinder, which is not constant due to the compressibility of the air and therefore does not guarantee an increase in speed in the hydraulic actuators.

Put otherwise, that set out above shows that all the hydropneumatic pumps on the market cannot guarantee a speed increase in the hydraulic actuators and cannot move large volumes of oil in one advance of the pneumatic cylinder, without significantly increasing its dimensions in the axial direction of the axis.

OBJECTIVES OF THE INVENTION

A first objective of this invention is to increase the volume of oil displaced at once, using one or more hydraulic pressure accumulators, working together as an integral part of the dual pump of this invention, its mechanism being activated only by compressed air or other pressurized gases.

It is a second objective of this invention to propose equipment capable of guaranteeing the pumping of oil using compressed air as an energy source.

It is a third objective of this invention to reduce physical space making the hydraulic pumps work in separate axes and parallel to each other, having in the center of the two axes the pneumatic cylinder, which is with the tip of its pneumatic rod connected to a bar that connects the two hydraulic liners that move.

A fourth objective of this invention is to move the hydraulic liners of the pumps instead of moving the hydraulic plunger or the pump piston, unlike the existing hydro-pneumatic pumps.

A fifth objective of this invention is that the unit allows the hydraulic actuators that use it to have a faster and more uniform displacement.

GENERAL DESCRIPTION OF THE INVENTION

The working basis for the "DUAL PNEUMO-HYDRAULIC PUMP UNIT" is the exclusive use of low-pressure compressed air, or other gases, which is used to move the pneumatic cylinder that has the function of pushing upwards and downwards two hydraulic liners, which are the moving parts of the hydraulic pumps because, in this invention, the pistons of the pumps are static and fixed on bearings and what really moves are the hydraulic liners which, when moving upwards, exert a pressure on the oil that is stored in that lower hydraulic chamber, driving that entire volume through a hole that exists in the piston rod that has a connection at its end and a one-way check valve, through which the oil is driven after forcing the opening of the valve check and, then the oil is pushed into a pressure accumulator, where it is stored under pressure and ready to be used, while in the same upward motion, the oil of the lower hydraulic chamber is pushed, and the upper hydraulic chamber draws the oil inwardly, such that when it arrives at the end of the stroke, the pneumatic cylinder receives a displacement direction reversal command, which happens through the change of position of a pneumatic directional valve and, from now onwards, the pneumatic cylinder begins to descend, exerting pressure on the oil in the upper hydraulic chamber, causing this oil to pass through the hole inside the lower hydraulic rod and force the opening of the check valve that is fixed on this face of the lower rod of the dual pump piston, and is conducted inside of the hydraulic pressure accumulator, where it will remain until the moment it is used and, accordingly, when reaching the end of the downward stroke, there will be a reversal in the pneumatic directional valve that controls the pneumatic cylinder and the dual pump enters into a continuous pumping regime, until the pressure accumulator is full and, when the pressure accumulator is full, the pumps will stop working, as the hydraulic pressure of the pressure accumulator has generated a pressure balance in the system and now the pneumatic cylinder, which maintains a constant force applied to the pumps, continues to exert and maintain the system pressure, but without consuming compressed air and acting as a pressure accumulator, which will always be ready to pump oil back into the system whenever there is a need to replace any volume used, however small, and when there is a need to send a large volume of oil in a single stroke, to act at some stage of the cycle that needs a very fast movement of one of the hydraulic actuators, the pressure accumulator will act so that this happens in a single stroke of total oil discharge, if it is programmed in the cycle of the machine that is using this invention.

Advantages of the Invention

In addition to the characteristics previously presented, the patent in question provides the following positive points to be highlighted:

- Much more compact equipment, occupies less physical space;
- The hydraulic compartment is cooled with the air escaping from the pneumatic cylinder, significantly lowering the oil temperature;
- It saves electric energy because the pumps will only move if there is movement of any hydraulic actuator of the machine or equipment that is using this invention;
- It produces low noise, as the moving parts are isolated and there is no metal-to-metal contact;
- There is no friction or metal-to-metal contact on the parts hydraulic pump furniture and therefore there is no wear or release of solid metal particles that damage and reduce the life of the seals;
- It does not have a venting system, which is the recirculation of the oil returning to the reservoir when the actuators are idle, this helps to keep the oil temperature low;
- It does not produce sparks caused by electricity, because it uses compressed air as an energy source and, therefore, it is the ideal type of equipment to use where there is gas in suspension or flammable products with risk of explosion or fire, often caused by the electric motor of the conventional hydraulic unit.

DESCRIPTION OF THE DRAWINGS

Next, to enable visualization of the constructivity, application and working of the "DUAL PNEUMO-HYDRAULIC PUMP UNIT", and to better clarify the technical report, explanations are provided with reference to the accompanying drawings, in which they are represented in an illustrative—not limitative—manner.

DETAILED DESCRIPTION OF THE INVENTION

Figure 1:
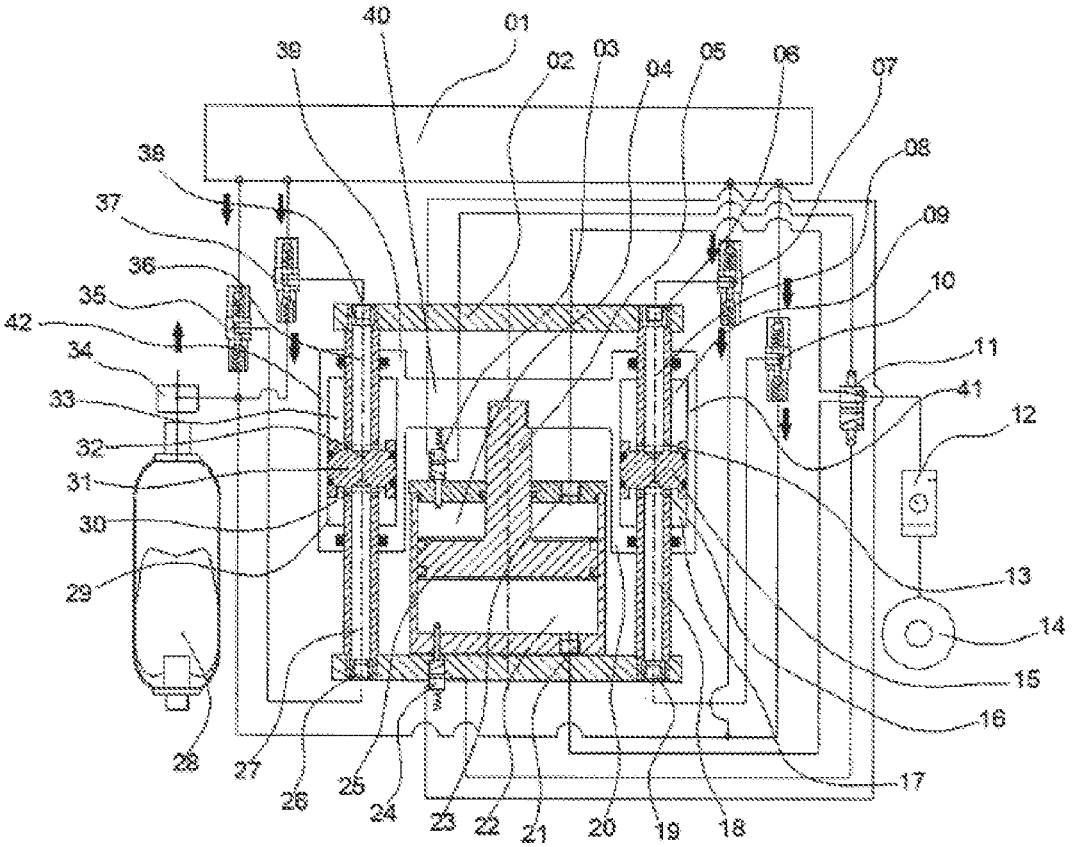
FIG. 1: Sectional drawing of the complete set.
Figure 2:
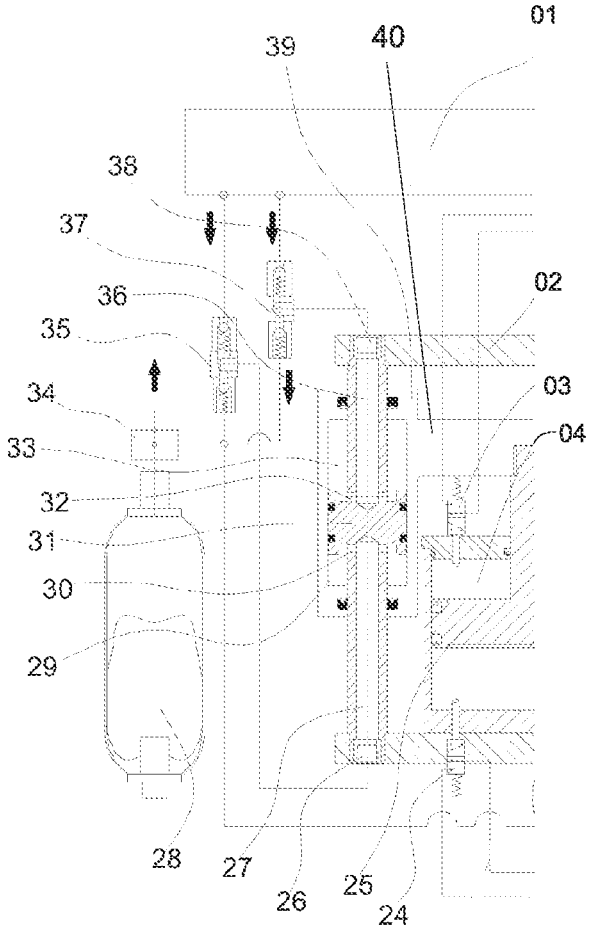
FIG. 2: Enlarged detail of one of the pumps.

The "DUAL PNEUMO-HYDRAULIC PUMP UNIT" consists of a central pneumatic cylinder (5) and two hydraulic piston pumps (20) and (39) which are mounted in parallel to the axis of the central pneumatic cylinder (5), and disposed one on each side.

In this invention, the hydraulic pumps (20) and (39) are pistons, work in reserve to conventional systems, that is, the hydraulic rods (8), (18), (27) and (36) and the plungers (15) and (31) are static and fixed on bearings, while what moves to perform the oil suction and pumping are the hydraulic liners (41) and (42) of the hydraulic pumps (20) and (39), which have the function of pumping pump the oil to the hydraulic pressure accumulator (28) and keeping it full and pressurized, always ready for use.

The pumping process beings with the air coming from a compressor (14), passing through an air handling unit (12) and feeding a pneumatic directional valve (11) and two other pneumatic directional valves (3) and (24), which are the valves responsible for reversing the central pneumatic cylinder (5).

When the pneumatic directional valve (11) is sending air to the lower pneumatic chamber (22), the upper pneumatic chamber (4) is open and discharging air into the atmosphere, causing the central pneumatic cylinder (5) to start to rise, taking together the two hydraulic liners (41) and (42) of the two hydraulic pumps (20) and (39), which are interconnected with each other by means of a part (40) that is fixed on the tip of the rod of the central pneumatic cylinder (5).

When the liners (41) and (42) of the hydraulic pumps (20) and (39) begin in rise, the oil in the lower hydraulic chambers (17) and (29) begins to be compressed and, with the force applied to that volume, it starts to be pushed out, passing through the lower hydraulic check valves (10) and (35), which open to allow the oil to be driven to the hydraulic pressure accumulator (28) and stored there.

While the oil from the lower hydraulic chambers (17) and (29) is pumped, the upper hydraulic chambers (9) and (33) are filled through suction performed by the upward displacement of the two liners (41) and (42) of the hydraulic pumps (20) and (39).

When the plunger (25) of the central pneumatic cylinder (5) reaches the end of the upward stroke, the upper pneumatic directional valve (3) will be activated and will pilot the pneumatic directional valve (11) which will change position, causing the pressurized air to be directed to the upper pneumatic chamber (4), while the air that was in the lower pneumatic chamber (22) is discharged into the atmosphere, causing the central pneumatic cylinder (5) to begin to descend, bringing with it the liners (41) and (42) of the hydraulic pumps (20) and (39), pushing the oil under pressure through the upper hydraulic holes (6) and (38) which conduct the oil to the upper hydraulic check valves (7) and (37), which are forced to open to allow the passage of oil that will be stored in the hydraulic pressure accumulator (28).

At the same time that the oil is being pumped into the hydraulic pressure accumulator (28), the lower hydraulic chambers (17) and (29) are being filled by the oil that is being drawn from the oil reservoir (1), forcing the opening of the lower check valves (10) and (35) and passing through the lower hydraulic holes (19) and (26) and led to the lower hydraulic chambers (17) and (29), until they are full and, at the end of the stroke of the plunger (25) of the central pneumatic cylinder (5), will activate the lower directional valve (24), which will pilot the pneumatic directional valve (11) causing it to change position and now start to direct the compressed air to the lower pneumatic chamber (22), passing through the air feed hole (21) of the lower chamber and, at the same time, the air which was compressed in the upper pneumatic chamber (4) begins to leave the air feed hole (23) of the upper chamber, passing through the pneumatic directional valve (11) and is discharged into the atmosphere, restarting the entire pumping process.

The hydraulic pumps (20) and (39) have a different operating principle, where we can see that the piston is static with the hydraulic rods (8), (18), (27) and (36) supported and fixed on bearings (2), thus providing a guarantee of alignment of the pumps.

With the displacement of the liners (41) and (42) of the hydraulic pumps (20) and (39), the oil is led into or out of the hydraulic chambers (9), (17), (29) and (33) through communication holes (13), (16), (30) and (32), which are independent and do not communicate with each other in any way, to allow the pumps to work with the suction and pressurization chambers independently.

When the pressure accumulator (28) is completely filled, the counter pressure generated by the balance of forces, will cause the pneumatic cylinder to stop and remain static, however, keeping the entire system pressurized, and only pumping oil again, automatically, when oil is used through the movement of any hydraulic actuator of the machine or equipment that is using this invention, and that is connected to the equipment through the hydraulic pressure outlet hole (34).

The invention claimed is:

1. A dual pneumo-hydraulic pump unit characterized by comprising:

two hydraulic piston pumps comprising liners;
a central pneumatic cylinder comprising a plunger;
a set of hydraulic rods;
a hydraulic pressure accumulator;
hydraulic plungers;
bearings;
an oil reservoir;
pneumatic directional valves;
upper hydraulic holes; and
upper hydraulic check valves;
wherein the central pneumatic cylinder works in the center of the two hydraulic piston pumps comprising liners;
wherein the two hydraulic piston pumps comprising liners are mounted parallel to the plunger of the central pneumatic cylinder, positioned one on each side; and
wherein the compressed air or other pressurized gases are used to move the central pneumatic cylinder, as a source of motor energy to pump oil under pressure to the hydraulic pressure accumulator for later activation of the hydraulic actuators.

2. The dual pneumo-hydraulic pump unit according to claim 1, characterized in that the pistons of the hydraulic pumps work in an inverted manner, where the set of hydraulic rods and the hydraulic plungers are static and fixed on a set of bearings.

3. The dual pneumo-hydraulic pump unit according to claim 1, characterized in that the liners of the hydraulic pumps move to draw and pump the oil from the oil reservoir to the hydraulic pressure accumulator.

4. The dual pneumo-hydraulic pump unit according to claim 1, characterized in that a pumping process is initiated by a compressor passing air through an air handling unit and feeding air to the pneumatic directional valves.

5. The dual pneumo-hydraulic pump unit according to claim 4, characterized in that the pneumatic directional valves act in the reversal of the central pneumatic cylinder.

6. The dual pneumo-hydraulic pump unit according to claim 1, characterized in that the storage of oil in the hydraulic pressure accumulator occurs through the opening of the upper hydraulic check valves that receive the oil from the upper hydraulic holes.

7. The dual pneumo-hydraulic pump unit according to claim 1, characterized by further comprising hydraulic chambers having communication holes, which are independent and do not communicate with each other.

8. The dual pneumo-hydraulic pump unit according to claim 1, characterized in that a set of lower hydraulic chambers are filled with oil drawn from the oil reservoir, forcing the opening of a set of lower hydraulic check valves.

9. The dual pneumo-hydraulic pump unit according to claim 1, characterized by further comprising a hydraulic pressure outlet hole.

* * * * *